US008616226B2

(12) United States Patent
Ma et al.

(10) Patent No.: US 8,616,226 B2
(45) Date of Patent: Dec. 31, 2013

(54) SHELTER WITH EXTENDED EAVES

(75) Inventors: Oliver Ma, Arcadia, CA (US); Marty Dotterweich, Escondido, CA (US)

(73) Assignee: Oliver Ma, Arcadia, CA (US)

( * ) Notice: Subject to any disclaimer, the term of this patent is extended or adjusted under 35 U.S.C. 154(b) by 18 days.

(21) Appl. No.: 13/092,765

(22) Filed: Apr. 22, 2011

(65) Prior Publication Data

US 2011/0308559 A1 Dec. 22, 2011

Related U.S. Application Data

(60) Provisional application No. 61/326,997, filed on Apr. 22, 2010.

(51) Int. Cl.
*E04H 15/50* (2006.01)

(52) U.S. Cl.
USPC ..... 135/145; 135/117

(58) Field of Classification Search
USPC ..... 135/117, 122, 131, 145, 146
See application file for complete search history.

(56) References Cited

U.S. PATENT DOCUMENTS

| | | | | |
|---|---|---|---|---|
| 2,197,791 A | | 8/1936 | Eddy | |
| 2,182,283 A | * | 12/1939 | Curtis | 135/136 |
| 2,555,220 A | | 5/1951 | Brown | |
| 2,962,034 A | | 11/1960 | Finlayson | |
| 3,621,857 A | * | 11/1971 | May et al. | 135/94 |
| 3,730,196 A | * | 5/1973 | Borskey | 135/88.11 |
| 3,874,398 A | | 4/1975 | Hendrickson | |
| 4,630,627 A | * | 12/1986 | Windows et al. | 135/122 |
| 4,641,676 A | | 2/1987 | Lynch | |
| 5,035,253 A | | 7/1991 | Bortles | |
| 6,431,193 B2 | | 8/2002 | Carter | |
| 6,718,995 B2 | | 4/2004 | Dotterweich | |
| 6,848,461 B2 | | 2/2005 | Tsai | |

(Continued)

FOREIGN PATENT DOCUMENTS

| | | |
|---|---|---|
| CN | 201531150 U | 7/2010 |
| CN | 201695750 U | 1/2011 |
| CN | 201695751 U | 1/2011 |

OTHER PUBLICATIONS

WIPO, U.S. International Search Authority, International Search Report and Written Opinion mailed Jul. 13, 2011 in International Patent Application No. PCT/US2011/033627, 8 pages.

(Continued)

*Primary Examiner* — Noah Chandler Hawk
(74) *Attorney, Agent, or Firm* — Inskeep IP Group, Inc.

(57) ABSTRACT

A shelter that includes a slider and a strut mechanism mounted on support posts of the shelter that automatically actuate and extend from the side of the support posts when the shelter is expanded from its collapsed state. The strut mechanism provides support for an eave that extends outside from all or a portion of the perimeter of the shelter defined by the corners of the support posts. An automatic hard-stop mechanism is incorporated into the support posts that prevent the eave sliders and strut mechanisms from becoming over-extended. The support posts are configured and oriented relative to the other components of the shelter frame and shelter boundary so to minimize the footprint or size of the shelter when in the collapsed state. Accordingly, the protected and shaded area offered by the shelter is greatly increased without sacrificing the stability and strength of the shelter, complicating the operation of the shelter, or increasing the weight, storability or cost of the shelter.

16 Claims, 13 Drawing Sheets

(56) References Cited

U.S. PATENT DOCUMENTS

| | | | | |
|---|---|---|---|---|
| 6,874,520 | B2 * | 4/2005 | Carter | 135/145 |
| 7,025,075 | B2 | 4/2006 | Suh | |
| 7,299,812 | B2 * | 11/2007 | Carter | 135/117 |
| 7,367,348 | B2 * | 5/2008 | Tsai et al. | 135/145 |
| 7,775,229 | B2 * | 8/2010 | Sy-Facunda | 135/117 |
| 2002/0074031 | A1 | 6/2002 | Morgante et al. | |
| 2002/0092555 | A1 * | 7/2002 | Chen et al. | 135/144 |
| 2004/0020526 | A1 | 2/2004 | Deng | |
| 2007/0051397 | A1 * | 3/2007 | Choi | 135/131 |
| 2007/0186967 | A1 * | 8/2007 | Zingerle | 135/145 |
| 2007/0221262 | A1 * | 9/2007 | Tsai et al. | 135/145 |
| 2010/0043856 | A1 | 2/2010 | Park et al. | |
| 2010/0051078 | A1 * | 3/2010 | Sy-Facunda | 135/145 |
| 2011/0061702 | A1 | 3/2011 | Lin | |

OTHER PUBLICATIONS

United States Patent and Trademark Office, Office Action mailed Mar. 8, 2012 in U.S. Appl. No. 12/870,728, 11 pages.

* cited by examiner

FIG. 12
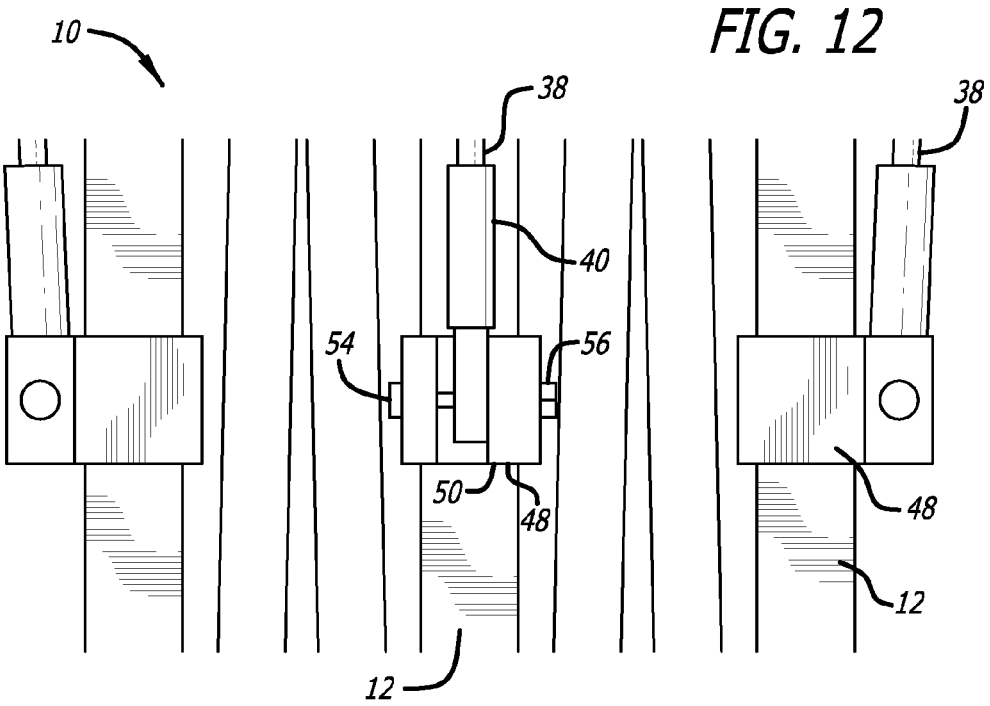
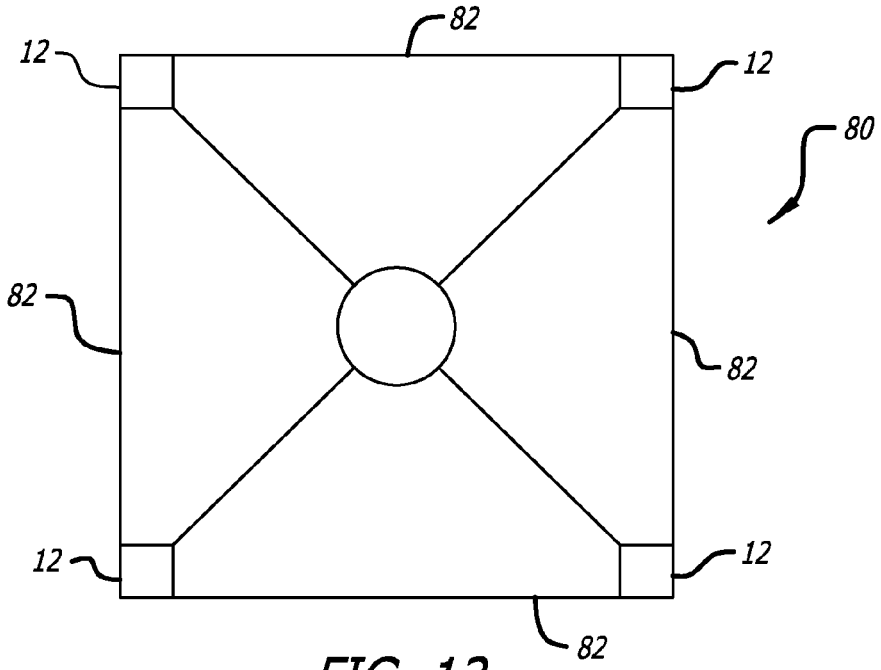
FIG. 13
(Prior Art)

SHELTER WITH EXTENDED EAVES

RELATED APPLICATIONS

This application claims priority to U.S. Provisional Application Ser. No. 61/326,997, filed Apr. 22, 2010, entitled Shelter With Extended Eaves, the contents of which are incorporated in their entirety herein.

FIELD OF THE INVENTION

The present invention generally relates to collapsible shelters and, more particularly, to a collapsible shelter having collapsible eaves and to shelters that are compact when in the collapsed state.

BACKGROUND OF THE INVENTION

Portable, free standing, shelters that have a collapsible frame structure that supports a canopy are well known. Portable shelters typically employ a cloth or plastic canopy attached to a light-weight, highly foldable skeleton or frame structure. The canopy provides a roof and/or walls for the shelter, and the frame structure provides support for the canopy, for example, the frame structure includes legs to elevate the roof and a system of trusses to support the roof and to generally stabilize the shelter. The frame structure often incorporates a compound, scissor-like, arrangement of a light-weight, tubular material such as aluminum. In order to maximize the usable area under a shelter, the frame structure is often designed so that the roof is supported solely by legs positioned near the perimeter of the roof. Stated alternatively, shelters do not typically employ an interior supporting post or leg such as a leg or post positioned in the center of shelter. An example of such a portable shelter is provided in U.S. Pat. No. 4,641,676 to Lynch the contents of which are herein incorporated in their entirety by reference.

To further maximize the usable area under the canopy, several portable shelter designs have incorporated eaves or awning-like structures that support the canopy beyond the exterior boundary or envelope defined by the legs of the shelter's frame. For example, U.S. Pat. No. 6,718,995 to Dotterweich describes a portable shelter having a canopy extension that extends out from one side of the shelter. The extension is supported by a relatively complex secondary network of trusses and cross-supports independent from that of the main body of the shelter. This single canopy extension design has the disadvantage of increasing the weight and size of the collapsed shelter, decreasing the effective height of the shelter along the outer boundary of the canopy extension, and being susceptible to deformation and damage from environmental forces, such as wind, due to the relatively large, unsupported extension.

U.S. Pat. No. 7,367,348 to Tsai et al., the contents of which are herein incorporated in their entirety by reference, describes a portable shelter having a canopy extension extending from four sides of the shelter. The canopy extension is supported by the end portions of certain of the trusses that support the canopy roof. The end portions supporting the canopy extension are entirely unsupported by secondary trusses or struts. This canopy extension design is also relatively susceptible to deformation and damage from environmental forces, such as wind, due to the unsupported nature of the canopy extension.

U.S. Publication No. 2007/0186967 to Zingerle, the contents of which are herein incorporated in their entirety by reference, describes a canopy extension that is supported by primary struts extending from the exterior corner of each support post. The primary strut is supported by one or more support strut that span between the primary strut and a network of side trusses. This canopy extension design has the disadvantage that a relatively large angle is formed between the support strut and the network of side trusses which, in turn, results in less fluid movement of the shelter frame when expanding and collapsing the shelter and increases the likelihood that the support strut will bind and/or kink. Furthermore, the fact that the primary struts extend from the corners of the support posts undesirably increases the collapsed size of the shelter.

Chinese Patent Application No. 2009201183292 to Kuanjun, the contents of which are herein incorporated in their entirety by reference, describes a canopy extension that is supported by primary struts extending from the exterior corners of each support post. The primary struts are supported by a support strut that is attached to the primary strut at one end and slidibly attached to the exterior corner of the support post at an opposite end. This canopy extension design has the disadvantages that the strut support is not limited in its upward movement on the support post. In the event that an environmental force, such as wind, acts against the support strut, the support strut will be prone to upward movement which, in turn, causes deformation and damage to the canopy extension and frame generally. Furthermore, the fact that the primary struts and support struts extend from the corners of the support posts undesirably increases the collapsed size of the shelter.

What is needed in the art is a shelter design that maximizes the area shaded and protected by the deployed shelter and that does so without sacrificing the stability and strength of the shelter, complicating the operation of the shelter, or increasing the weight, collapsed size or storability, or cost of the shelter.

SUMMARY OF THE INVENTION

In light of deficiencies of prior art collapsible shelters, the present invention provides a collapsible shelter that includes a slider and strut mechanism mounted on support posts of the shelter that automatically actuate and extend from the corners of the shelter when the shelter is expanded from its collapsed state. The strut mechanism provides support for an eave that extends outside all or a portion of the perimeter of the shelter defined by the corners of the support posts. In this manner the protected and shaded area offered by the shelter is greatly increased without sacrificing the stability and strength of the shelter, complicating the operation of the shelter, or increasing the weight, storability or cost of the shelter.

The present invention also provides an automatic hard-stop mechanism that prevents the eave slider and strut mechanism from becoming over-extended during improper operation of the shelter or during harsh environmental conditions such as high winds.

The present invention also provides shelter support posts that are configured and oriented in a manner that minimizes the footprint of the increased awning shelter when in the collapsed state. In a preferred embodiment, the support posts are configured to be oriented at a 45 degree angle so that the eave slider and strut mechanism can be attached to the support posts without increasing the footprint, or envelope, of the shelter when in the collapsed state.

BRIEF DESCRIPTION OF THE DRAWINGS

These and other aspects, features and advantages of which embodiments of the invention are capable of will be apparent and elucidated from the following description of embodiments of the present invention, reference being made to the accompanying drawings, in which

FIG. 12 is a side elevation view of a portion of a collapsed frame structure of a shelter according to one embodiment of the present invention.

FIG. 13 is a plan view of an expanded frame structure of a shelter according to the prior art.

DETAILED DESCRIPTION OF PREFERRED EMBODIMENTS

Figure 1:
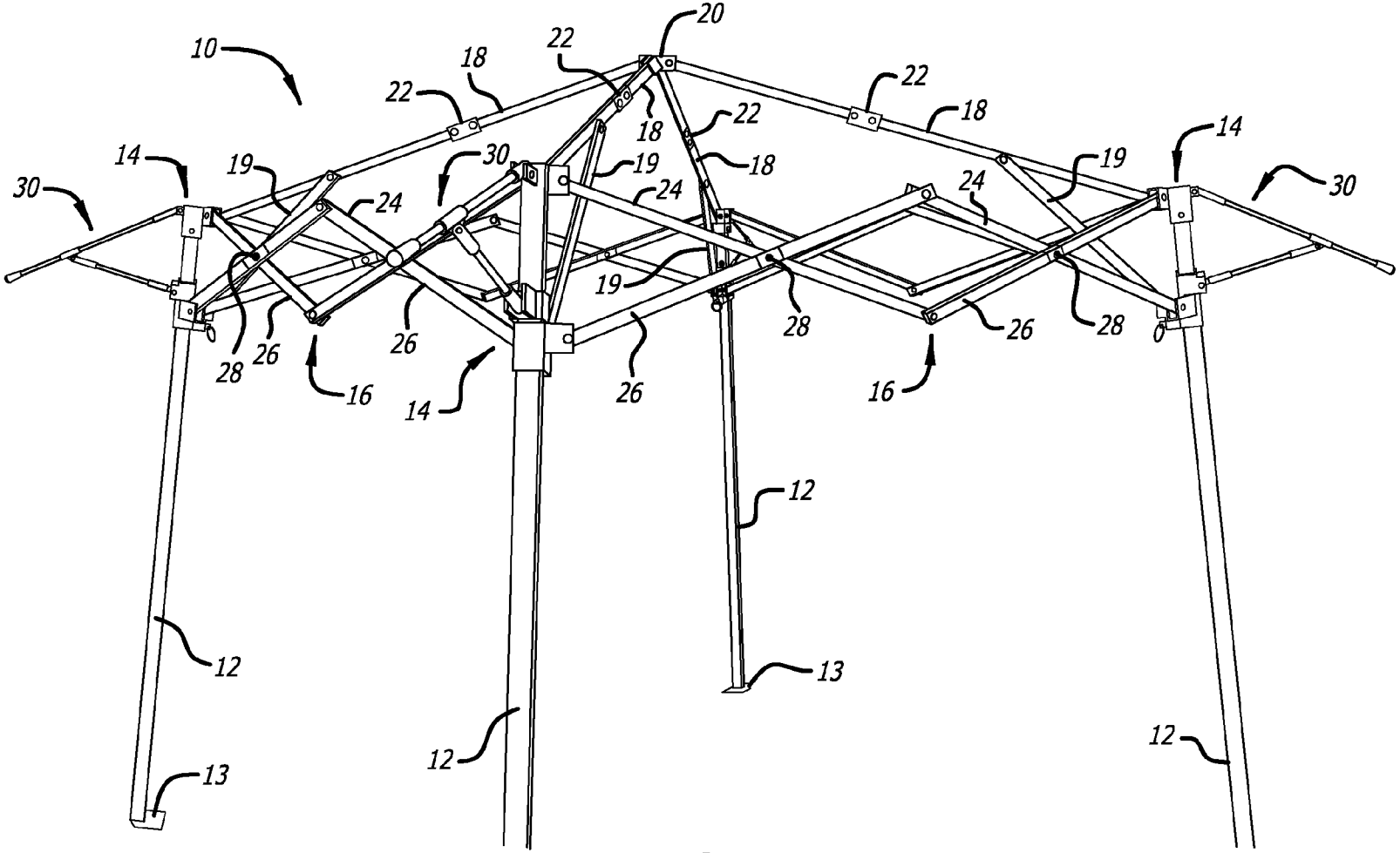
FIG. 1 is a perspective view of an expanded frame structure of a shelter according to one embodiment of the present invention.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

Figure 2A:
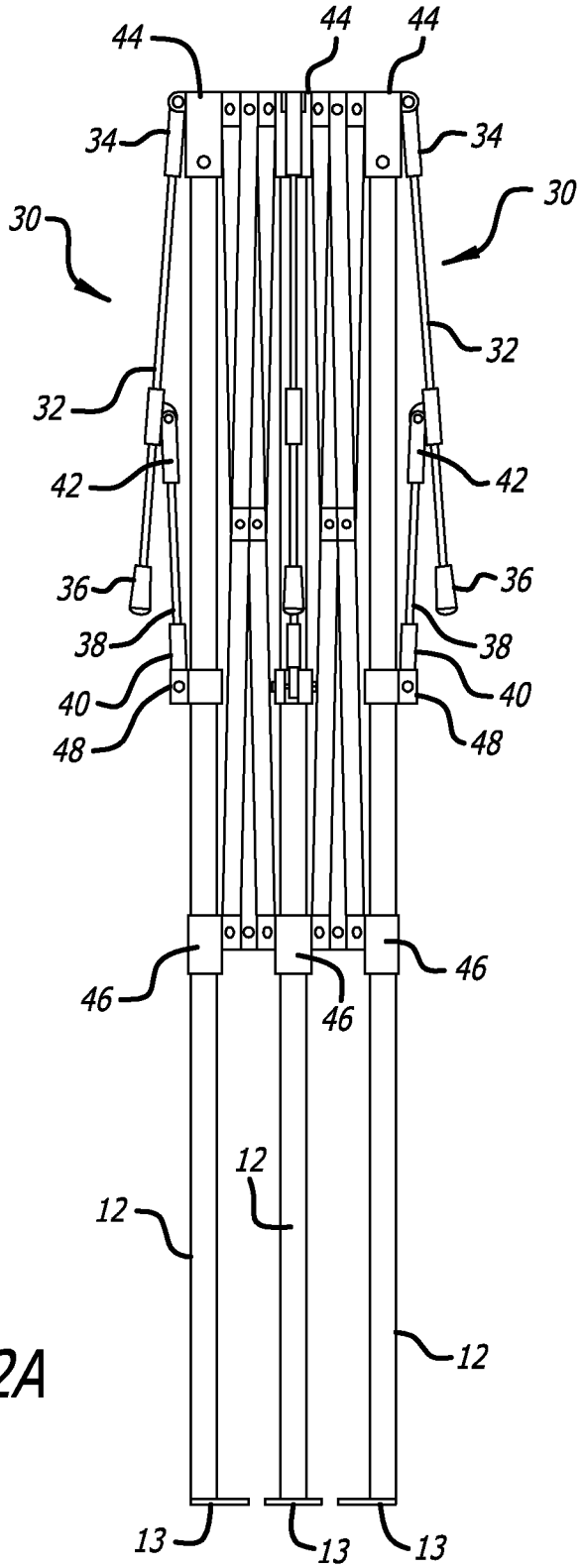
FIG. 2A is a perspective view of a collapsed frame structure of a shelter according to one embodiment of the present invention.
Figure 2B:
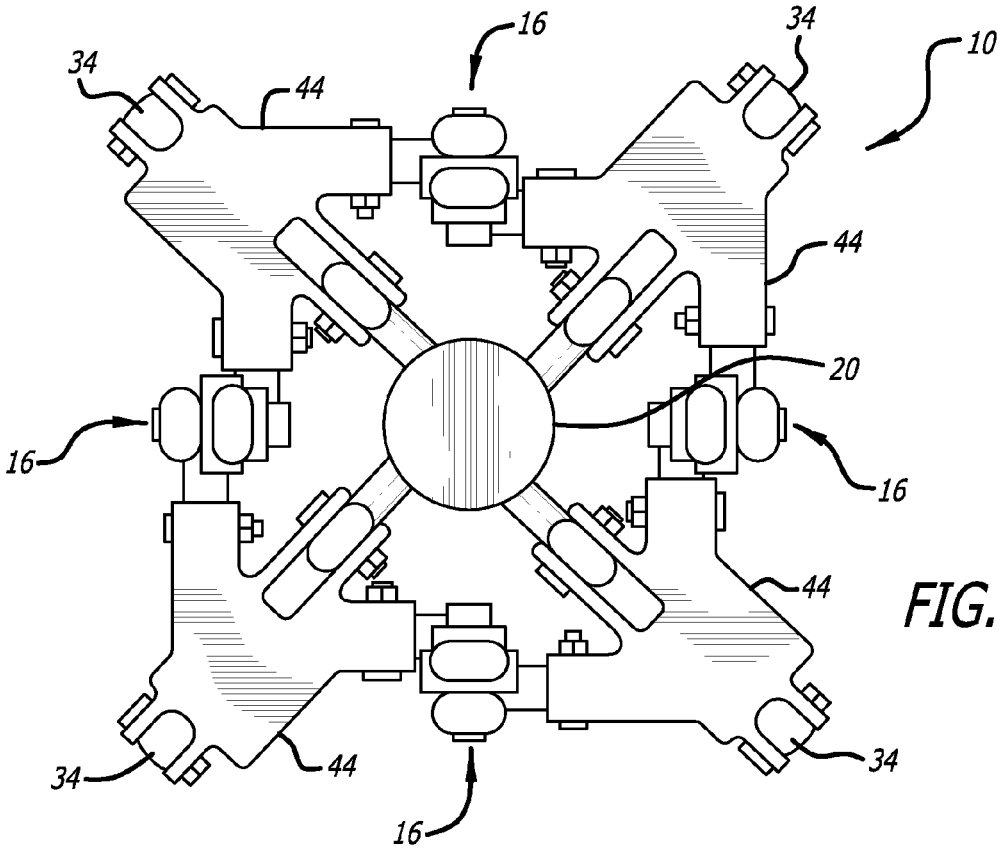
FIG. 2B is a plan view of a collapsed frame structure of a shelter according to one embodiment of the present invention.

FIG. 1 shows an expanded, deployed frame 10 of a shelter according to one embodiment of the present invention. FIG. 2A shows the same frame 10 in the collapsed, non-deployed state from a side view, and FIG. 2B shows the same frame 10 in the collapsed, non-deployed state from a plan view. For the sake of clarity, in the figures, the present invention is shown without a canopy attached to the frame 10. Broadly speaking, the frame 10 employs posts 12 extending upward from post bases 13 to corner assemblies 14. The corner assemblies 14 function to associate the posts 10 with side trusses 16, peak trusses 18, and eave assemblies 30.

Figure 14:
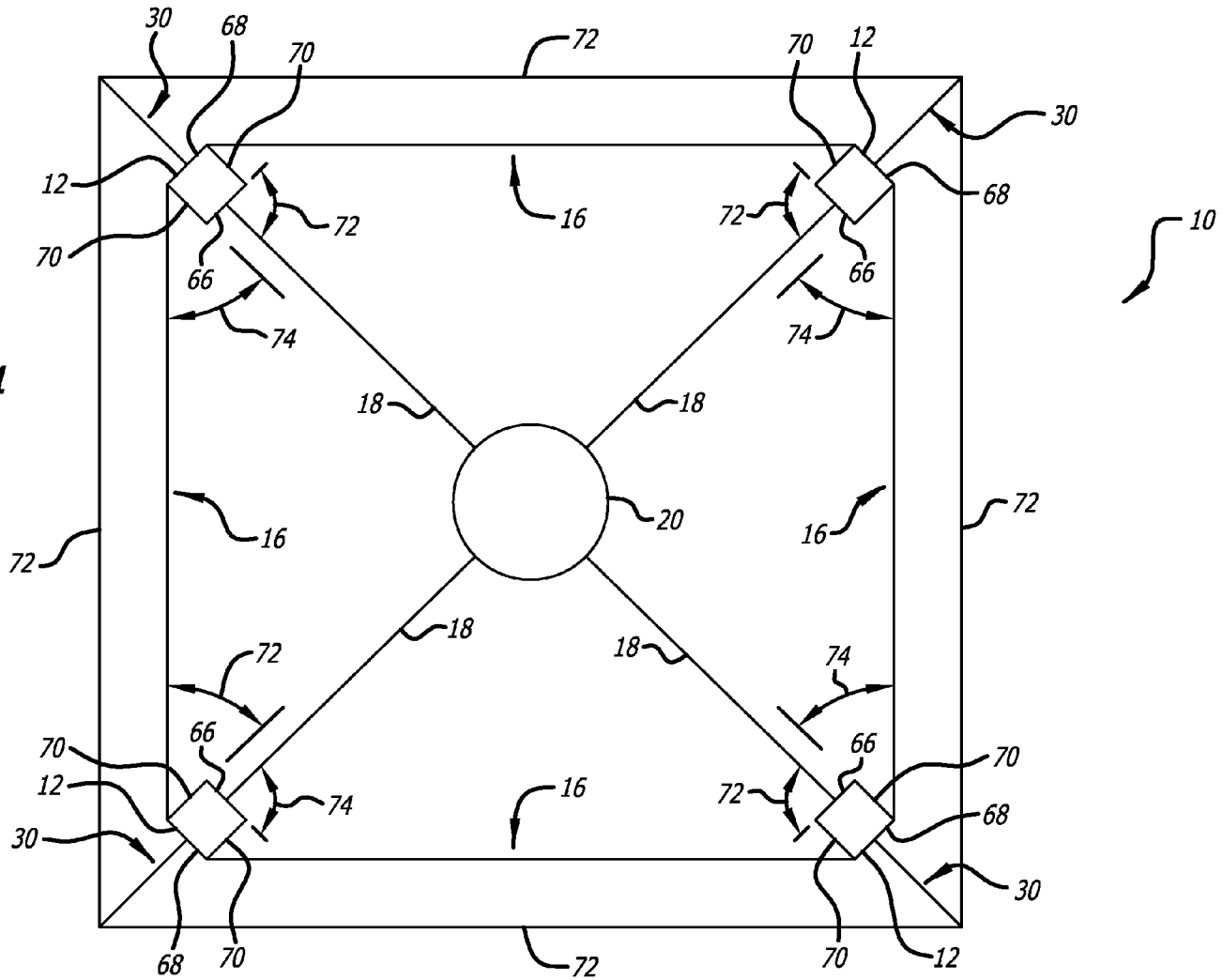
FIG. 14 is a plan view of an expanded frame structure of a shelter according to one embodiment of the present invention.

FIG. 14 is a simplified plan view of the frame 10 shown in FIG. 1. For the sake of clarity, an outer perimeter or envelope 72 is shown in FIG. 14 that represents the outer boundary of the shade or shelter provided by expanded shelter having a canopy according to the present invention. It is noted that while FIGS. 1 and 14 shows the frame 10 as having an approximately rectangular footprint or floor plan, it is contemplated that the present invention may employ frames 10 that have alternative footprints such as circles, squares, or ovals. In a preferred embodiment, the posts 12 have an approximately rectangular cross-sectional shape. Each post 12 has an interior side 66, an exterior side 68, and two intermediary sides 70.

Figure 3:
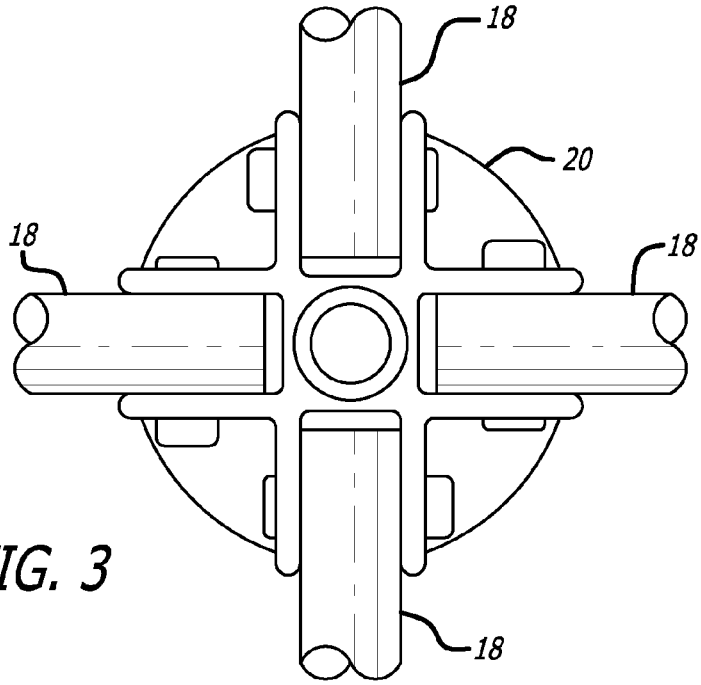
FIG. 3 is a plan view of a peak junction according to one embodiment of the present invention.
Figure 4:
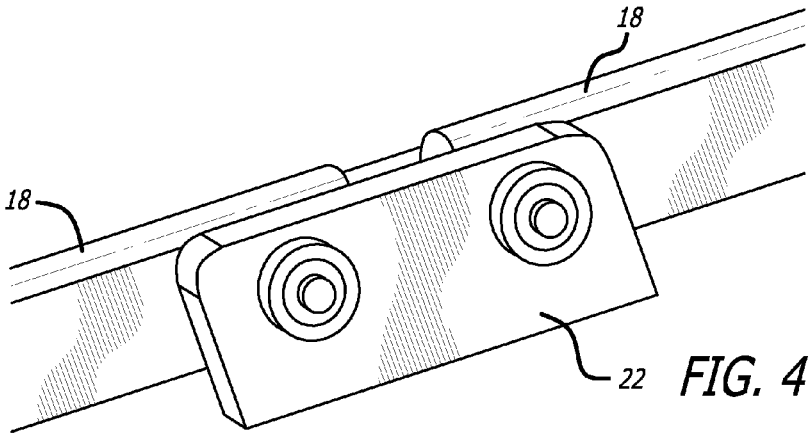
FIG. 4 is a perspective view of a peak truss hinge according to one embodiment of the present invention.

With reference to FIGS. 1 and 14, a peak junction 20 functions to associate the peak trusses 18 to one another at a location in the approximate center of the horizontal area occupied by the shelter at an elevation above a height of the top of the posts 12. In this manner, the peak junction 20 forms a peak or high-point of the roof of the frame 10. An expanded view of an underside of the peak junction 20 is shown in FIG. 3. As shown in FIG. 1, the peak trusses 18 employ peak truss hinges 22 that allow the peak trusses 18 to be folded in order that they may achieve a more compact size when the frame 10 is collapsed. FIG. 4 shows an expanded view of the peak truss hinge 22. The peak trusses 18 are supported by peak truss supports 19. A proximal end 17 of the peak truss support 19 is attached to the corner assembly 14 and a distal end 21 of the peak truss support 19 is attached to the peak truss 18.

Figure 5:
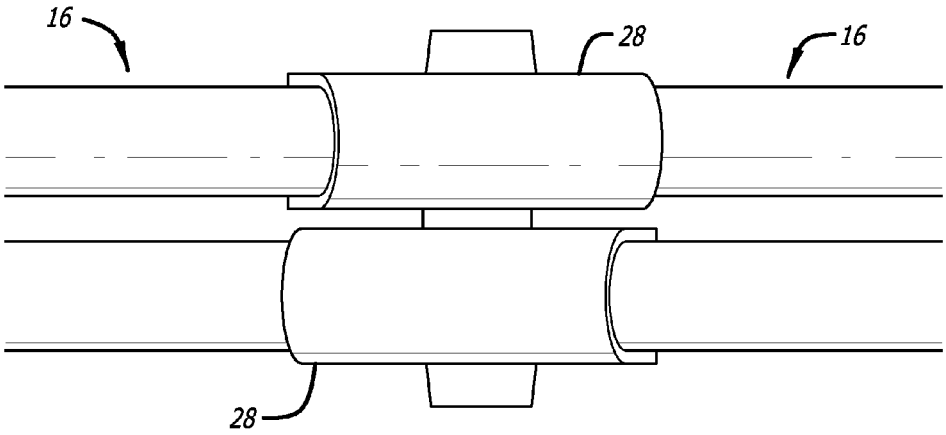
FIG. 5 is a perspective view of a side truss hinge according to one embodiment of the present invention.

The side trusses 16 employ a scissor-like assembly spanning between posts 12. The side trusses 16 have an upper arm 24 and a lower arm 26 that cross one another and attached to one another at a side truss hinge 28. FIG. 5 shows an expanded view of the side truss hinge 28.

Figure 6:
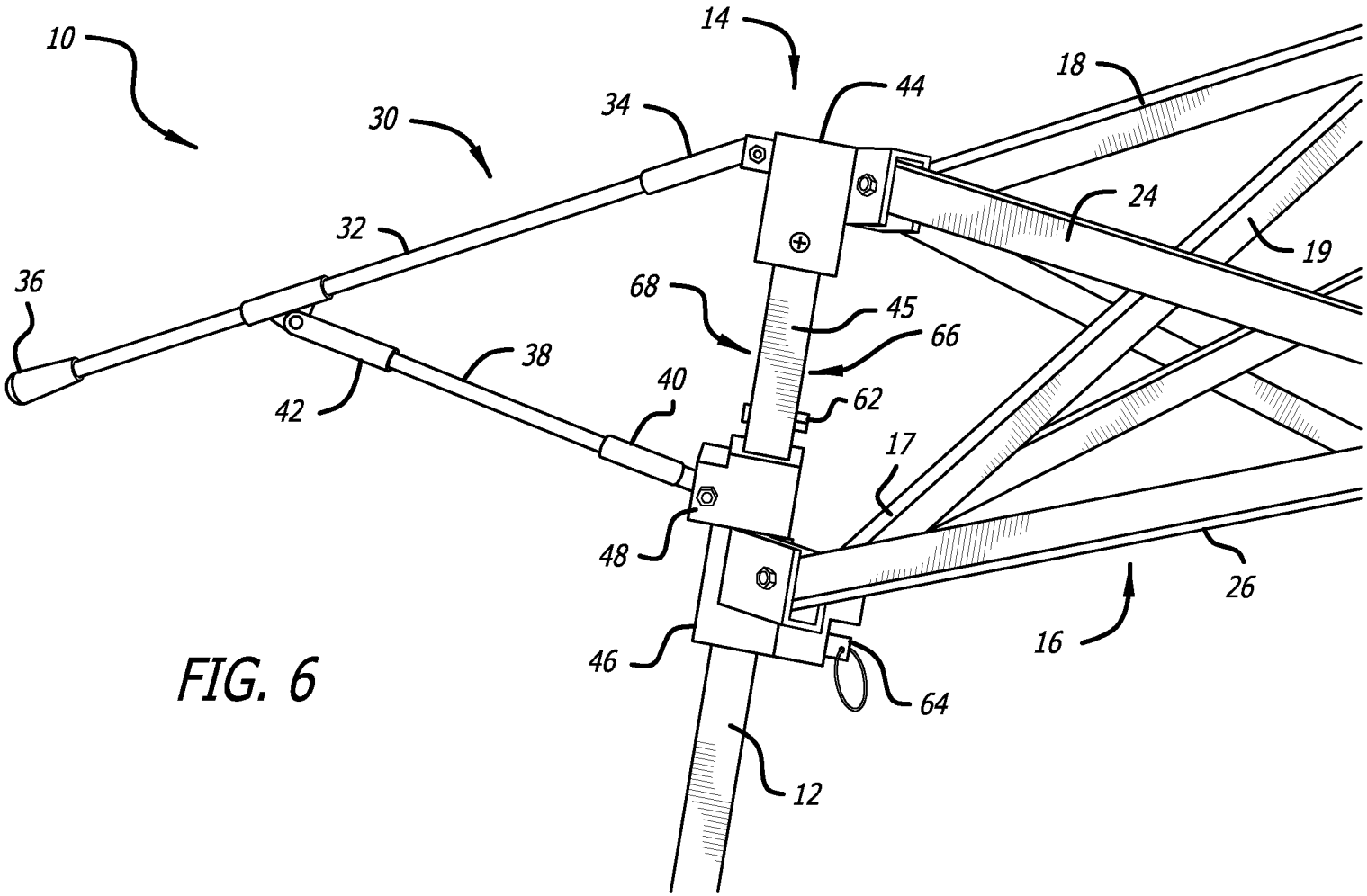
FIG. 6 is a perspective view of a portion of an expanded frame structure of a shelter according to one embodiment of the present invention.

As best shown in FIG. 6, the eave assembly 30 employs an eave strut 32 having a proximal end 34 attached to the corner assembly 14 and a distal end 36 extending outward from the frame 10. The eave assembly 30 further comprises a strut support 38 having a proximal end 40 attached to the corner assembly 14 and a distal end 42 attached to the eave strut 32. When the frame 10 is in a collapsed, non-deployed state, such as shown in FIG. 2, the distal end 36 of the eave strut 32 pivots towards the post base 13. When the frame 10 is expanded to an open state, the distal end 36 of the eave strut 32 pivots outward away from the post 12.

Figure 7:
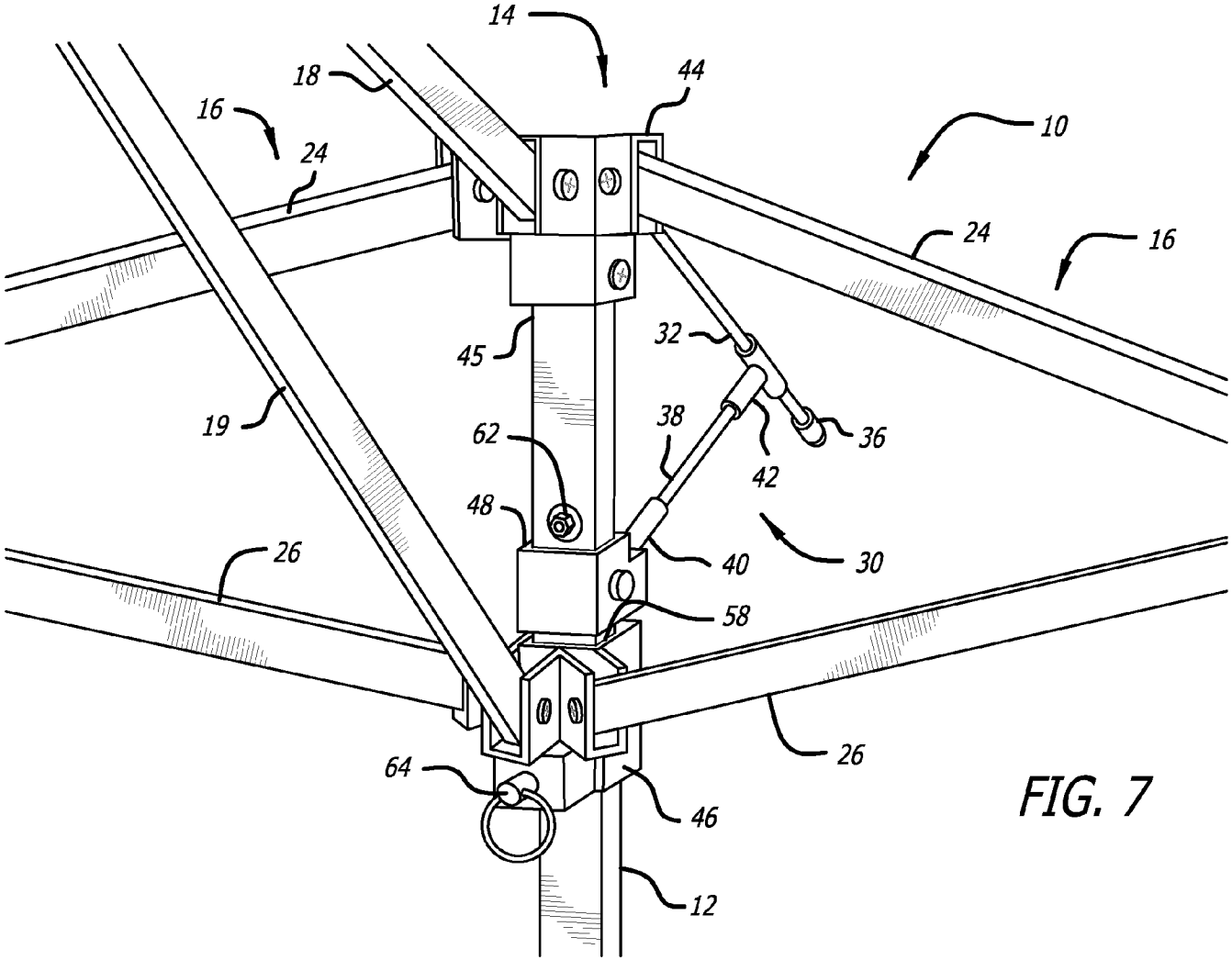
FIG. 7 is a perspective view of a portion of an expanded frame structure of a shelter according to one embodiment of the present invention.

As shown in FIGS. 6 and 7, the corner assemblies 14 employ an upper coupling 44 fixed to a upper portion 45 of the post 12, a lower coupling 46 slidably attached to the post 12, and a eave slider 48 slidably attached to the post 12 between the upper coupling 44 and the lower coupling 46.

Figure 8A:
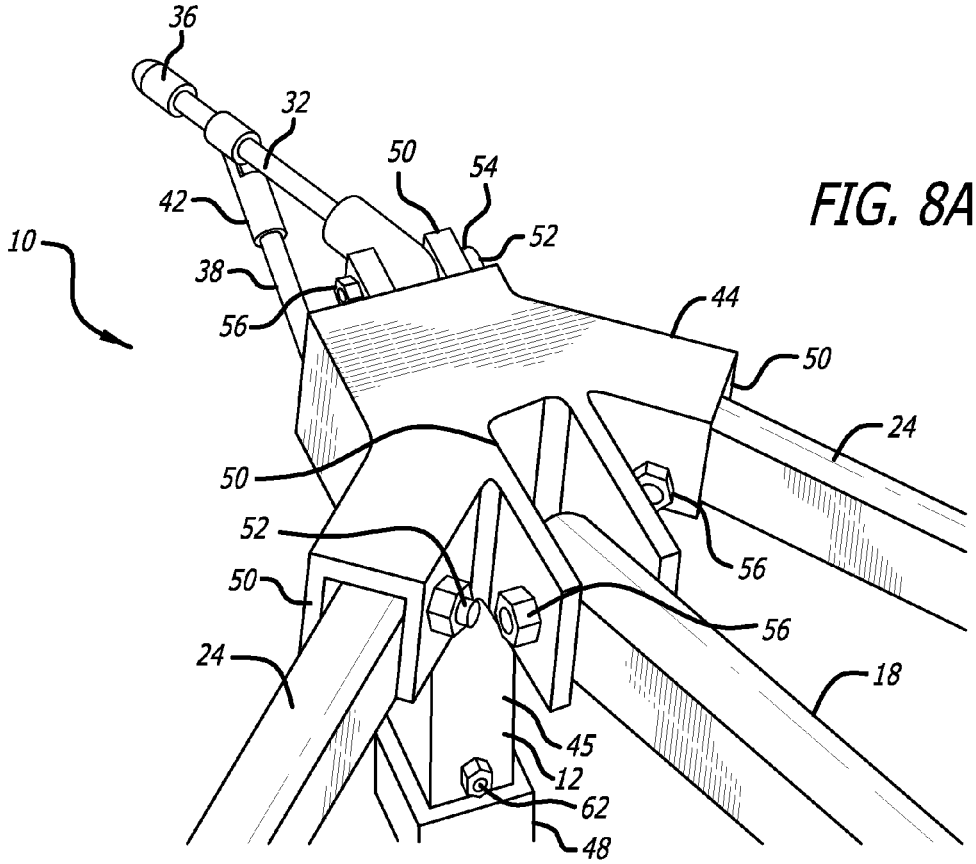
FIG. 8A is a perspective view of a portion of an expanded frame structure of a shelter according to one embodiment of the present invention.
Figure 8B:
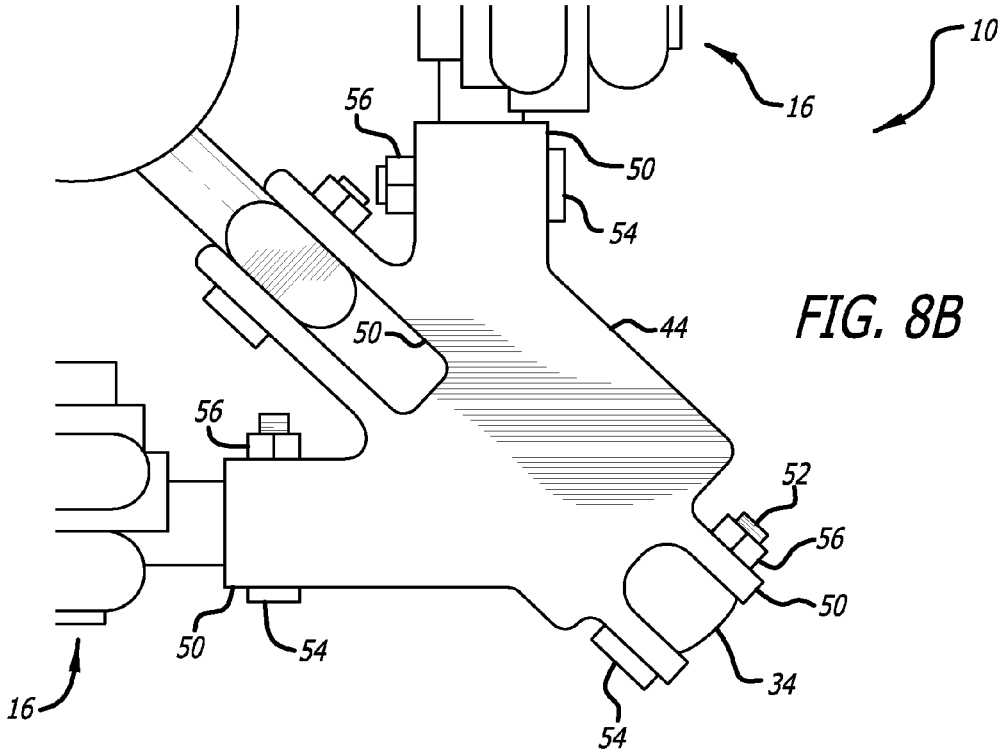
FIG. 8B is a plan view of a portion of a collapsed frame structure of a shelter according to one embodiment of the present invention.

As shown in FIG. 8A in which the frame 10 is in the deployed, expanded state, the upper coupling 44 serves to attach and associate one post 12 with the upper arms 24 of two different side trusses 16, one peak truss 18, and one eave strut 32. These components are attached to the upper coupling 44 by insertion of an end of the component, for example the proximal end 34 of the eave strut 32, into a receiving portion 50 formed in and/or by the upper coupling 44. The component end is secured within the receiving portion 50 by passing a member such as a bolt 52 through a first side of the receiving portion 50, through the component end, such as the proximal strut end 34, and through a second side of the receiving portion 50. The bolt 52 may, for example be secured in position by threading a nut 56 over an end of the bolt 52 opposite a bolt head 54. FIG. 8B shows an plan view of the upper coupling 44 when the frame 10 is in the non-deployed, collapsed state.

Figure 9:
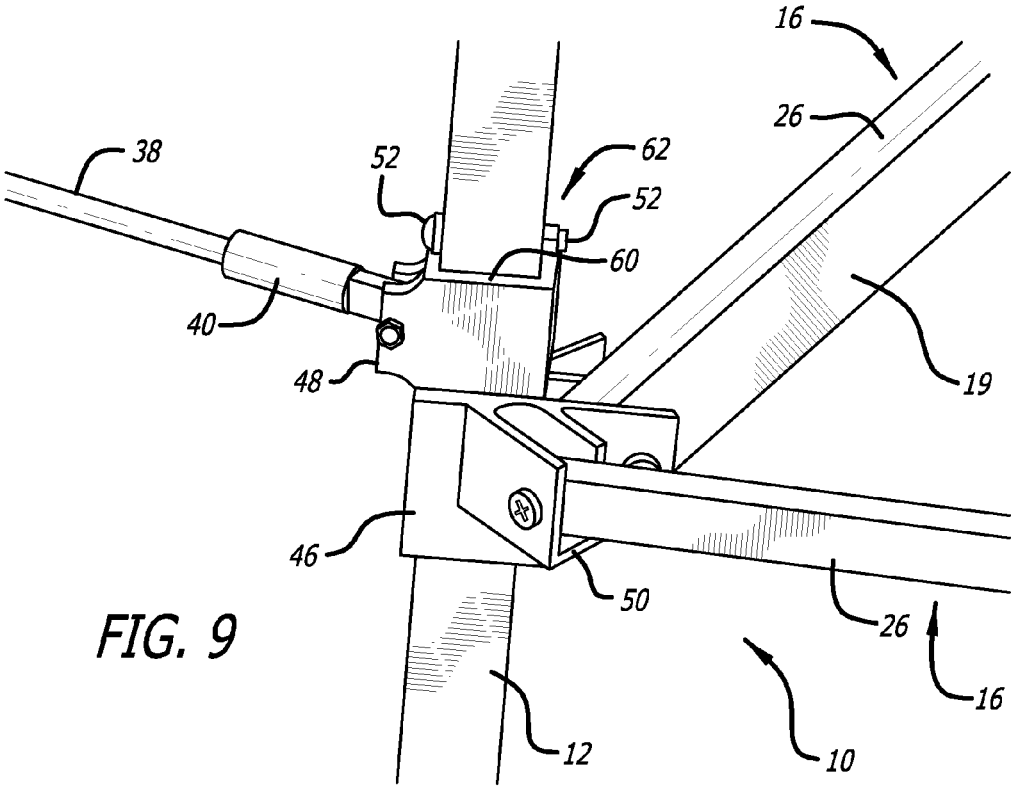
FIG. 9 is a perspective view of a portion of an expanded frame structure of a shelter according to one embodiment of the present invention.
Figure 10:
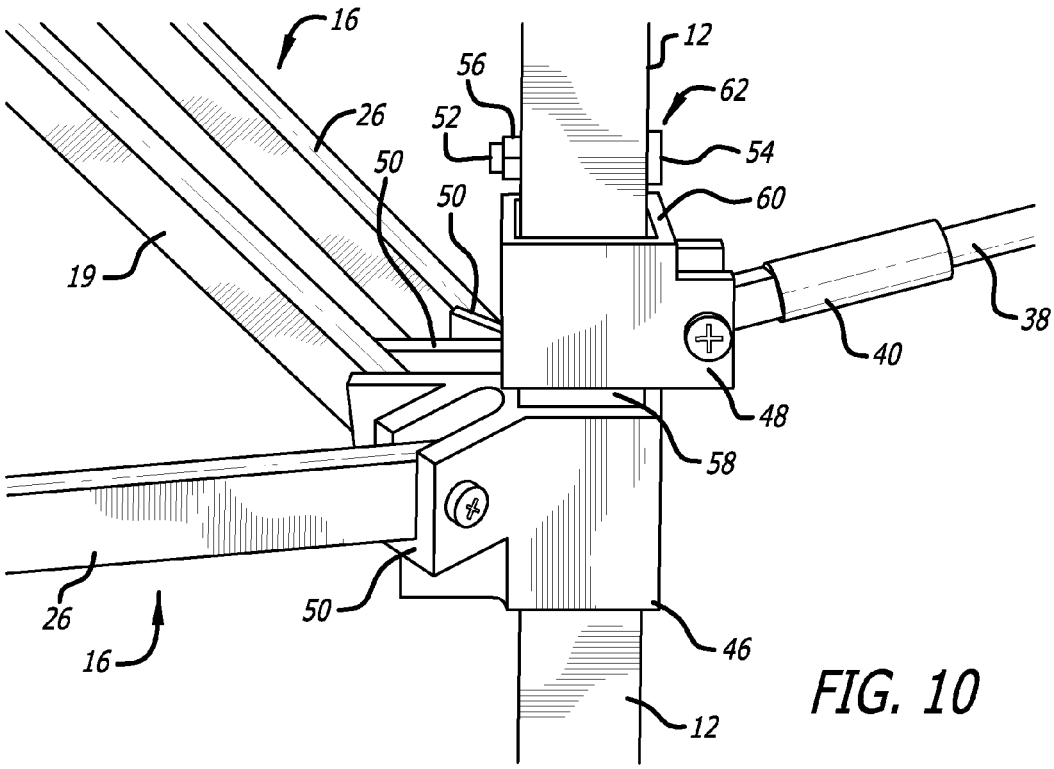
FIG. 10 is a perspective view of a portion of an expanded frame structure of a shelter according to one embodiment of the present invention.
Figure 11:
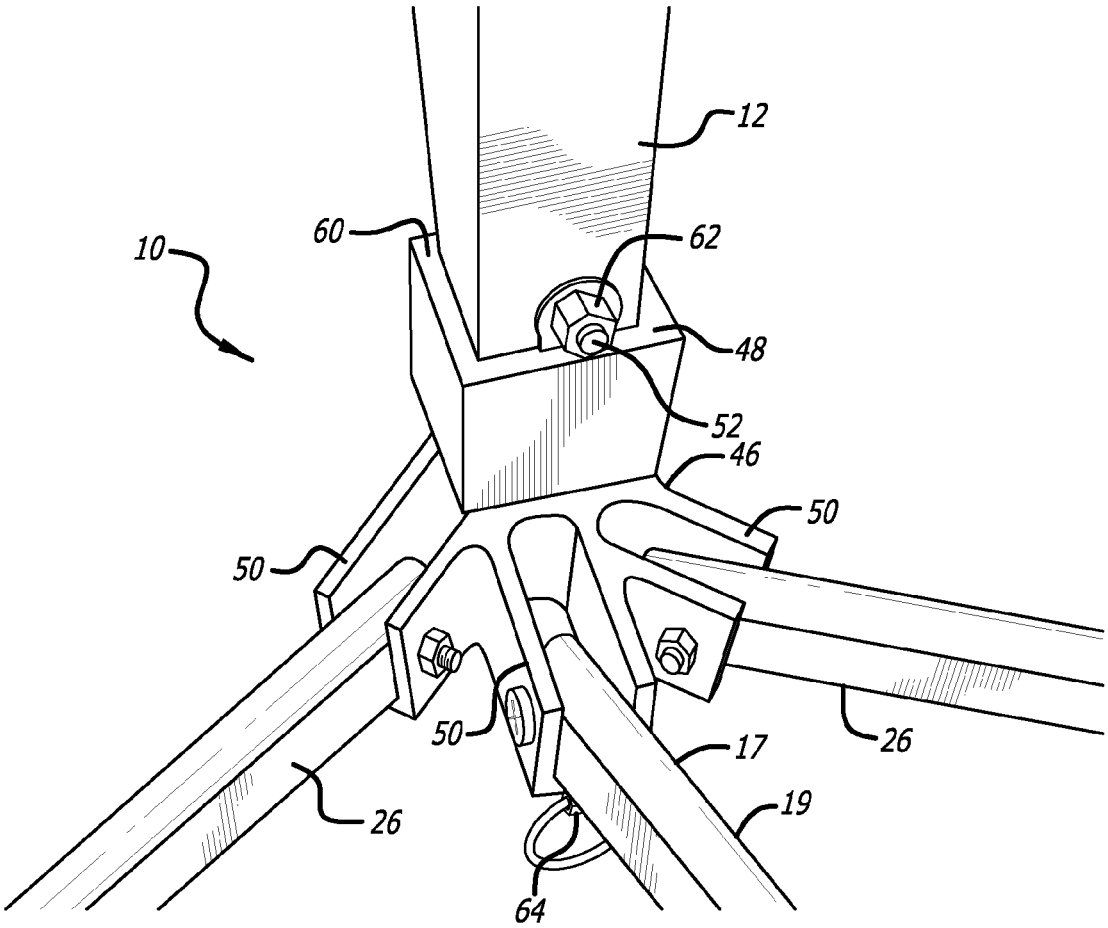
FIG. 11 is a perspective view of a portion of an expanded frame structure of a shelter according to one embodiment of the present invention.

As shown in FIGS. 9 and 10, the lower coupling 46 employs a lower coupling post aperture 58 through which the post 12 is slidably positioned. As seen in FIG. 9-11, the lower coupling 46 serves to attach and associate one post 12 with the lower arms 26 of two different side trusses 16 and the proximal end 17 of one peak truss support 19. These components are attached to the lower coupling 46 as described above regarding the attachment of components to the upper coupling 44.

As shown in FIGS. 5 and 6, the lower coupling 46 further employs coupling lock 64 which functions to secure the lower coupling 46 at the desired location along the post 12. The lower coupling lock 64 is a biased or spring-loaded pin lock that is incorporated into the body of the lower coupling 44. The coupling lock 64 engages a receiving aperture, not shown, formed in post 12. It will be understood that while the coupling lock 64 has been shown incorporated into an interior side of the lower coupling 46, the coupling lock 64 may alternatively be incorporated into any of the exterior sides of the lower coupling 46.

With reference to FIGS. 6, 7, and 9-12, the eave slider 48 is positioned on the post 12 between the upper coupling 44 and the lower coupling 46. The eave slider 48 employs a post aperture 60 through which the post 12 is slidably positioned. The eave slider 48 serves to attached and associate the post 12 with the proximal end 40 of the eave strut support 38. The proximal end 40 of the eave strut support 38 is attached to the eave slider 48 as described above regarding the attachment of components to the upper coupling 44. FIG. 12 shows a side view of the eave slider 48 when the frame 10 is in the non-deployed, collapsed state.

Figure 15A:
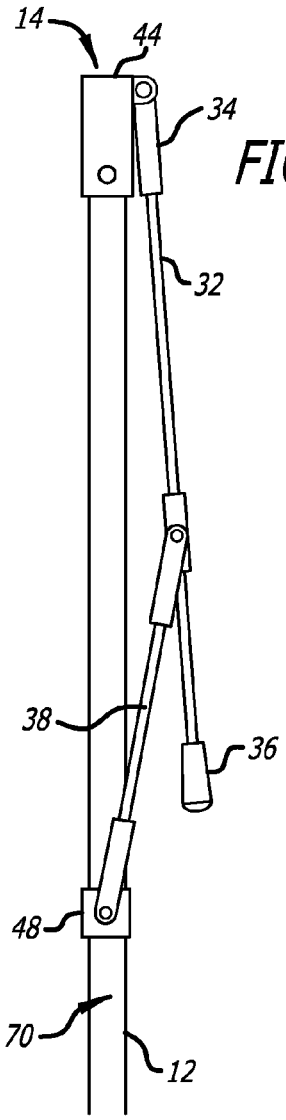
FIG. 15A is a side elevation view of a portion of a partially collapsed frame structure of a shelter according to one embodiment of the present invention.
Figure 15B:
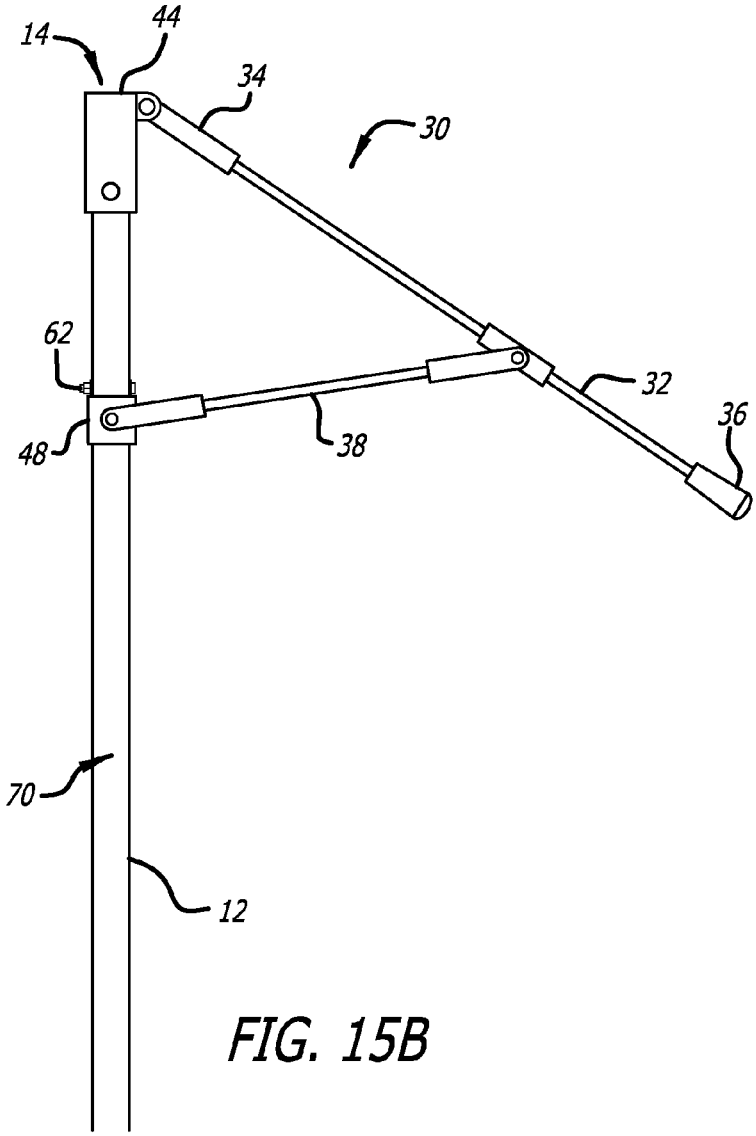
FIG. 15B is a side elevation view of a portion of an expanded frame structure of a shelter according to one embodiment of the present invention.
Figure 15C:
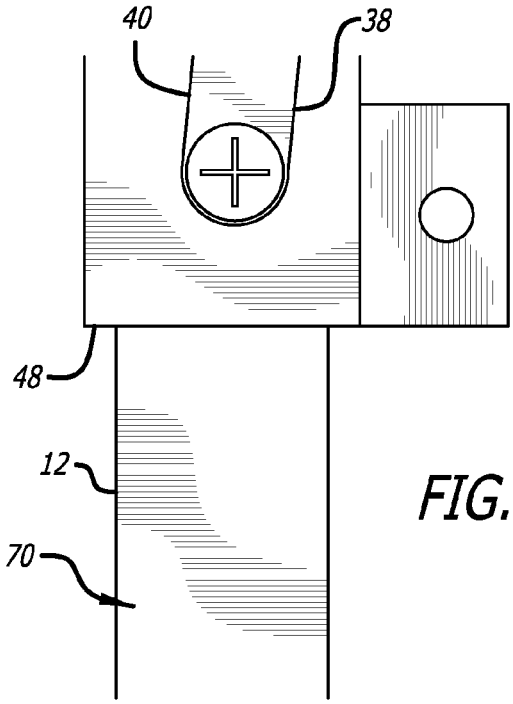
FIG. 15C is a side elevation view of a portion of an expanded frame structure of a shelter according to one embodiment of the present invention.

While FIGS. 1, 2A, 6, 7, 9, 10, and 12 show that the proximal end 40 of the strut support 38 is attached to the eave slider 48 on the exterior side 68 of the post 12, it will be understood that other attachment configurations are contemplated. For example, the proximal end 40 of the strut support 38 may alternatively attach to the eave slider 48 on one of the intermediary sides 70 of the post 12, as shown in FIGS. 15A-15C. In another embodiment, instead of one longitudinal element, the strut support 38 comprises two longitudinal elements and the proximal ends 40 of the strut supports 38 attach to the eave slider 48 at each of the two intermediary sides 70.

Figure 16:
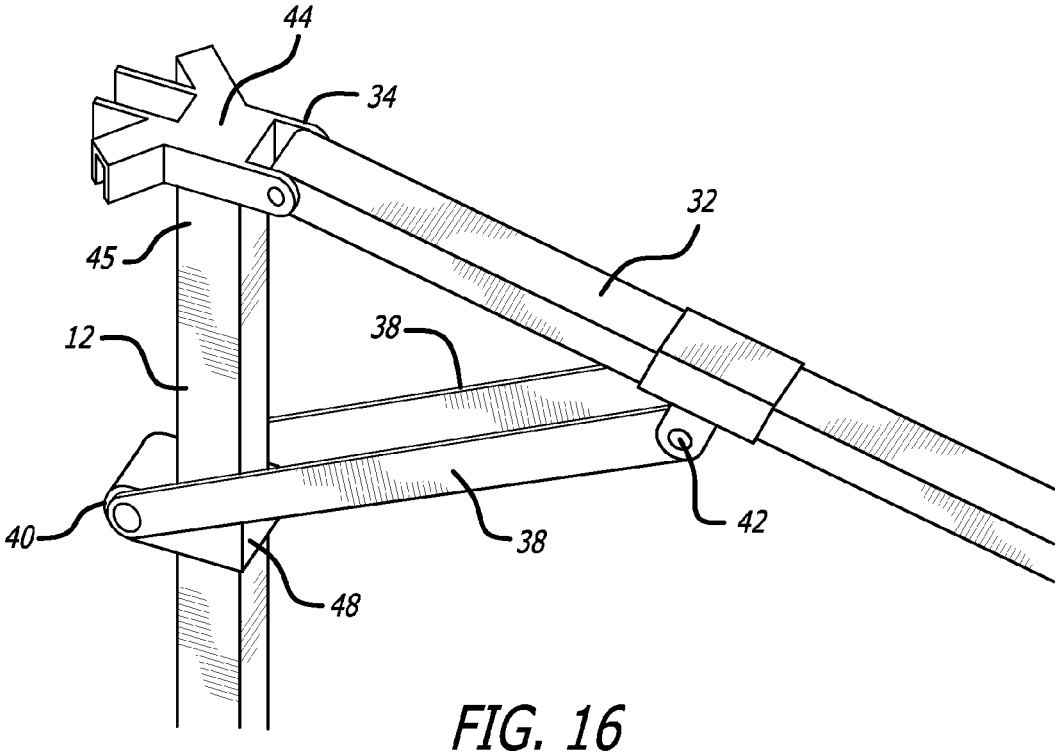
FIG. 16 is a perspective view of a portion of an expanded frame structure of a shelter according to one embodiment of the present invention.

In a preferred embodiment, instead of one longitudinal element, the strut support 38 comprises two longitudinal elements. The proximal ends 40 of the two longitudinal elements of the strut supports 38 pass by each of the two intermediary sides 70 of the post 12 and attach to the eave slider 48 on the interior side 66 of the post 12, as shown in FIG. 16.

This configuration provides at least two advantages to the frame 10. First, by positioning the pivot point for the proximal end 40 of the strut supports 38 on the interior side of the post 12, a sharper angle is formed at the point where the strut supports 38 attach to the eave strut 32. This, in turn provides for smoother operation, i.e. smoother expanding and collapsing of the eave assemblies 30 and the frame 10. Second, employing two longitudinal elements of the strut support 38 increases strength of the eave assemblies 30 and, more particularly, aids in preventing the eave assemblies from moving laterally. This advantage is further enhanced by the increased rigidity provided by passing the longitudinal elements of the strut support 38 on each side of the post 12. The post 12 serving as a lateral truss between the two longitudinal elements.

In one embodiment of the present invention, the corner assembly 14 and hence the frame 10, is further improved by employing an eave stop 62. With reference to FIGS. 6, 7, 8A, 9-11, and 15A, the eave stop 62 is a projection from the post 12 that is fixed at a desired distance along a length of the post 12 above which it is undesirable for the eave slider 48 to travel. As shown in the figures, in one embodiment of the present invention, the eave stop 62 employs a bolt 52 passed through the post 12 with a nut 56 threaded onto the end of the bolt 52 opposite the bolt head 54. The eave stop 62 may be positioned on one side of the post 12 but is preferably positioned on two opposite sides of the post 12. For example, it is contemplated that eave stops 62 be placed on both of the intermediary sides 70 of the post 12 or one eave spot 62 on the interior side 66 of the post 12 and one eave stop on the exterior side 68 of the post 12.

The eave stop 62 is particularly advantageous in that the eave stop 62 assists in securing the eave slider 48 in the desired position on the post 12. In operation, when the frame 10 is transitioned from a collapsed state to an expanded, deployed state, the lower coupling 46 is urged upward towards the upper portion 45 of the post 12 causing expansion of the truss network comprising the peak trusses 18 and side trusses 16. The lower coupling 46 contacts the eave slider 48 and urges the eaves slider 48 upward along the post 12. As the eave slider 48 moves upward along the post 12, the eave slider 48 causes the eave strut 32 to pivot outward away from the exterior side 68 of the post 12, thereby providing support for a canopy eave, not shown, that is configured to extend beyond the perimeter of the posts 12 of the frame 10. The lower coupling lock 64 eventually locks into place on the post 12 when the frame 10 is in the fully expanded, deployed state.

In harsh environmental conditions such as high winds, there is a risk that the canopy of the shelter is caught by the wind and is caused move or deform the frame 10 that supports the canopy. This is especially problematic due to cantilever-like configuration of the eave assemblies 30. In order to prevent the eave assemblies 30 from being forced upward in such a circumstance, the eave stop 62 is disposed on the post 12. In the event the wind on the canopy urges the eave assembly 30 in the upwards direction, an upper surface of the eave slider 48 contacts the eave stop 62. The eave stop 62 thereby prevents the upward movement or the eave slider 48 and, hence, the deformation of the eave assembly 30.

Of particular importance to certain embodiments of the present invention is the orientation of the rectangular posts 12 relative to the other components of the frame 10. As best shown in FIG. 7-11 and particularly in FIG. 14, the posts 12 of the frame 10 of the present invention are rotated approximately 45 degrees relative to the envelope 84 of the deployed frame 10. Stated alternately, the posts 12 are rotated such that the peak trusses 18 attach to the upper coupling 44 which is attached to the post 12 such that a angle 72 of approximately 90 degrees is formed between the peak trusses 18 and the with the interior side 60 of the posts 12. Likewise, the eave struts 32 extend perpendicularly from the exterior side 68 of the posts 12. In contrast, the side trusses 16 attach to the upper coupling 44 and lower coupling 46 which are attached to the post 12 such that a angle 74 of approximately 45 degrees is formed between the side trusses 16 and the with the intermediary sides 70 of the posts 12.

By way of comparison, as shown in FIG. 13, prior art collapsible shelter frames 80 employ posts 12 that are positioned such that the sides of the posts 12 are parallel to the sides of the shelter envelope 82. Likewise, the peak trusses 18 of the prior art shelter frames 80 attach to the posts 12 at a corner of the posts 12 and form an angle of approximately 45 degrees with the sides of the post 12.

The orientation of the posts 12 relative to the envelope 84 and other components of the frame 10 of the shelter of the present invention provides distinct advantages over the prior art shelters. For example, the rotation of the posts of the frame 10 of the present invention results in a space occurring between the exterior side 68 of the post 12 and the corner of the shelter envelope when the frame 10 is in the collapsed state. Within this space, the eave strut 32 and strut support 38 of the eave assembly 30 are disposed, when the frame 10 is in the collapsed state. As a result, a collapsible shelter having an eave feature according to the present invention can be collapsed into substantially the same envelope as that of a shelter that does not provide an eave. Further advantages are provided by the orientation of the post 12 of the frame 10 by imparting increased resistance to lateral forces, such as wind, to the frame 10.

One of skill in the art will understand that the frame structure 10 of the present invention may be constructed from a variety of materials known in the art to facilitate light-weight designs and foldability. For example, the posts 12, the peak trusses 18, the peak truss supports 19, the side trusses 16, the eave struts 32, and the strut supports 38 may be formed of an alloy including, but not limited to, tubular and/or solid aluminum. The upper coupling 44, the lower coupling 46, the eave slider 48, the peak junction 20, the side truss hinges 28, and other similar components may be formed of, for example, a solid alloy or a molded plastic.

Although a particular embodiment of the invention has been illustrated and described, various changes may be made in the form, composition, construction and arrangement of the parts herein without departing from the scope of the invention. Accordingly, the examples discussed above should be taken as being illustrative and not limiting in any sense.

What is claimed is:

1. A collapsible shelter comprising:

a frame structure and a cover enclosing at least a top portion of the frame structure, the frame structure comprising:

a plurality of support posts interconnected to one another by a network of trusses;

a strut having a proximal end portion attached to one of the plurality of support posts and a distal end portion extending from said one of the plurality of support posts in a radial direction away from a center of the shelter;

a strut support having a first end slidably attached to said one of the plurality of support posts below where the strut is attached to said one of the plurality of support posts, a second end of the strut support attached to the strut and extending away from said one of the support posts in a same direction as the strut extends from said one of the support posts; and a strut support stop associated with said one of the plurality of support posts between the proximal end portion of the strut and the first end portion of the strut support.

2. The collapsible shelter of claim 1 wherein the strut support stop extends from opposite sides of said one of the plurality of support posts.

3. The collapsible shelter of claim 1 wherein the strut support stop comprises a bolt and nut.

4. The collapsible shelter of claim 1 wherein the strut support is attached to said one of the plurality of support posts on a side of said one of the plurality of support posts opposite a side of the said one of the plurality of support posts attached to the proximal end portion of the strut.

5. The collapsible shelter of claim 1 wherein the strut forms an angle of approximately 90 degrees with a surface of said one of the plurality of support posts.

6. The collapsible shelter of claim 1 wherein elongated vertical sides of the plurality of support posts are nonparallel to sides of the shelter.

7. A structure for reinforcing a frame for a portable shelter comprising:

an upper coupling attached to a top portion of a support post and a network of side trusses;

a lower coupling attached to the support post below the upper coupling and to the network of side trusses;

a stop incorporated into the support post between the upper coupling and the lower coupling;

a strut extending from the upper coupling in a direction radially away from a center of the shelter; and a strut support having a proximal end attached to a slider and a distal end attached to the strut, the slider slidably attached to the support post between the lower coupling and the stop, the strut support pivots relative to the slider on a side of the slider opposite a side of the slider from which the distal end of the strut support extends towards the strut.

8. The structure for reinforcing a frame for a portable shelter of claim 7 wherein the stop extends from opposite sides the support post.

9. The structure for reinforcing a frame for a portable shelter of claim 7 wherein the strut support comprises two elongated members.

10. The structure for reinforcing a frame for a portable shelter of claim 7 wherein the strut forms an angle of approximately 90 degrees with a surface of the support post.

11. A method for enhancing the stability of an eave of a collapsible shelter comprising the steps of:

attaching a distal end of a peak truss to a support post;

attaching a proximal end of an eave strut to the support post;

attaching a proximal end of an eave strut support to the support post below the eave strut and above an arm of a side truss, the eave strut support extending from the support post on an opposite side of the support post from which the peak truss attaches to the support post;

attaching a distal end of the eave strut support to the eave strut; and interposing a stop on the support post between the proximal end of the eave strut and the proximal end of the eave strut support.

12. The method for enhancing the stability of an eave of a collapsible shelter of claim 11 wherein the step of attaching a proximal end of an eave strut to the support post comprises forming an angle of approximately 90 degrees between the eave strut and an elongated, vertical surface of the support post.

13. The method for enhancing the stability of an eave of a collapsible shelter of claim 11 wherein the step of attaching a proximal end of an eave struts support to the support post below the eave strut and above an arm of a side truss comprises attaching the proximal end of the eave strut support to a side of the support post opposite a side of the support post from which the distal end of the eave strut support extends towards the strut.

14. The method for enhancing the stability of an eave of a collapsible shelter of claim 11 wherein the step of attaching a proximal end of an eave struts support to the support post below the eave strut and above an arm of a side truss comprises employing an eave strut support having two elongated members.

15. The method for enhancing the stability of an eave of a collapsible shelter of claim 11 wherein the step of interposing a stop on the support post between the proximal end of the eave strut and the proximal end of the eave strut support comprises forming projections on opposite sides of the support post.

16. The method for enhancing the stability of an eave of a collapsible shelter of claim 11 further comprising the step of orienting elongated vertical sides of the support post so as to be nonparallel to the side truss of the collapsible shelter when the shelter is in an collapsed state.

* * * * *